US006301840B1

(12) United States Patent
Spinelli

(10) Patent No.: US 6,301,840 B1
(45) Date of Patent: Oct. 16, 2001

(54) PROTECTIVE LINER ASSEMBLY FOR A FASCIA BOARD OR LIKE MEMBER

(76) Inventor: Sam Spinelli, 9877 NW. 26 Pl., Sunrise, FL (US) 33322

( * ) Notice: Subject to any disclaimer, the term of this patent is extended or adjusted under 35 U.S.C. 154(b) by 0 days.

(21) Appl. No.: 09/444,362

(22) Filed: Nov. 22, 1999

(51) Int. Cl.[7] ..... E04B 7/00

(52) U.S. Cl. ..... 52/96; 52/717.03; 52/716.8

(58) Field of Search ..... 52/631, 96, 287.1, 52/717.03, 716.2, 716.8, 717.05, 204.53, 211, 212, 213, 215; 428/906, 43

(56) References Cited

U.S. PATENT DOCUMENTS

| | | | | |
|---|---|---|---|---|
| 1,233,536 | * | 7/1917 | Adams | 52/211 |
| 1,723,158 | * | 8/1929 | Guy | 52/96 |
| 3,716,132 | * | 2/1973 | Lewyckyj | 428/906 |
| 3,812,002 | * | 5/1974 | Lurie | 428/43 |
| 5,246,775 | * | 9/1993 | Loscuito | 428/343 |
| 5,616,387 | * | 4/1997 | Augst | 428/906 |
| 5,642,810 | * | 7/1997 | Warner | 206/484 |
| 5,658,632 | * | 8/1997 | Krabill | 428/43 |
| 5,712,210 | * | 1/1998 | Windisch | 428/906 |
| 5,819,739 | * | 10/1998 | Levavi | 428/906 |
| 5,878,457 | * | 3/1999 | Cox | 428/906 |
| 5,893,243 | * | 4/1999 | Ortner | 52/211 |
| 5,972,456 | * | 10/1999 | Esquivel | 428/43 |
| 6,001,200 | * | 12/1999 | Hibler | 428/343 |

* cited by examiner

*Primary Examiner*—Carl D. Friedman
(74) *Attorney, Agent, or Firm*—Malloy & Malloy, P.A.

(57) ABSTRACT

A protective liner assembly designed to overly and substantially sealingly engage the plurality of exposed surface portion of a fascia board or like fascia member of the type typically found in the construction of both domestic and commercial buildings. The liner assembly comprises an elongated strip of material having sufficient flexibility to be rolled upon itself into a roll having a spiral-like configuration to at least partially define a stored position thereof. The elongated strip includes a plurality of strip sections segregated from one another by a plurality of weakened zones, preferably in the form of score lines, such that each of the strip sections can be selectively folded or otherwise moveable relative to one another into an operative position for overlying, protective and substantially sealing engagement with the exposed surface portions of the fascia member. The sealing engagement between the contact faces of each of the strip sections and the corresponding ones of the plurality of exposed surface portions is accomplish by utilizing an adhesive, thereby eliminating the use of mails, staples or any other conventional connector which will normally secures the protective strip to the fascia member by penetrating the fascia member thereby rendering it susceptible to deterioration at the cite of penetration.

10 Claims, 2 Drawing Sheets

PROTECTIVE LINER ASSEMBLY FOR A FASCIA BOARD OR LIKE MEMBER

BACKGROUND OF THE INVENTION

1. Field of the Invention

The present invention is directed towards a protective liner assembly in the form of an elongated protective strip formed of a flexible plastic or like material capable of being rolled upon itself and into a roll, and thereby, defining a stored position. Alternatively, the elongated protective strip may be selectively oriented in an operative position which conforms to the dimension and configuration of a plurality of exposed surface portions of a fascia board, strip or like fascia member, which is to be protected. Interconnection of the protective liner strip to the exposed surface portions of the fascia member is accomplished without the use of nails, staples or other conventional penetrating connectors, and more in particular, through the use of an adhesive or like composition, which provides an at least partially sealed engagement between the inner, contact face of the elongated protective strip and the exposed surface portions of the fascia board or like member.

2. Description of the Related Art

In the construction of many homes and other buildings, fascia boards, strips or like fascia members are utilized to improve the exterior, aesthetic appearance of the building being constructed. Typically, fascia members are located so as to overly, and thereby, hide areas such as rafters, roof truss ends, etc. Fascia members are conventionally used to trim the upper surfaces of a vertical wall, and typically, a number of fascia boards are assembled in either a linear or angular orientation therealong, with the result that a plurality of end joints or seams are defined by the positioning or substantially abutting engagement of corresponding ends of the individual, cooperatively disposed, fascia boards or members. However, it is not uncommon for such end joints to be misaligned, with the result that a gap or space will exist between the engaging ends of the correspondingly positioned fascia members, which thereby causes the ends to be exposed to the weather and all of the various weather conditions. As one example, this exposed joint or seam is susceptible to seepage by rain water or the like, which in turn, results in potential rotting or other deterioration, in that the fascia members are normally formed of wood. Such deterioration not only affects the fascia members but also other, correspondingly or adjacently positioned building components, which the fascia members are supposed to protect.

In order to solve the problems associated with the deterioration of fascia members, especially in the vicinity of end joints or seams, conventional methods comprise the sealing of such joint or seam areas, using some type of known sealing compound. Such sealing methods and techniques have not been effective as evidenced by the common and frequent deterioration of the fascia members, particularly at the location of the end joints.

In an effort to overcome the problems and disadvantages associated with conventional construction techniques, particularly relating to the utilization and protection of fascia members, fascia assemblies have been designed which include sheathing or overlying panels, made of sheet metal or similar, relatively non-corrosive material. However, these attempts have generally been unsuccessful in that the underlying, wood material fascia members, and particularly, the end joints or seals between correspondingly disposed fascia members, are not adequately sealed and are, therefore, still susceptible to deterioration from exposure to harsh weather conditions. In addition, the attachment of such metal sheet material to the fascia member is normally accomplished through the use of nails, staples, or other somewhat conventional connectors of the type which penetrate both the metal sheet and the fascia member, itself. The penetration by nails or other conventional connectors is known, however, to add to the problem of deterioration, since water will have a tendency to leak into the fascia member at the site of penetration of the nail. Moreover, nails or like conventional connectors do not provide for any reliable kind of "sealing engagement" between the inner surface of the metal sheet protector and the exposed surface of the fascia member. As such, water will have a tendency to pass between the inner surface of the protective cover and the outer surface of the fascia member, since a true sealing engagement is not accomplished therebetween.

Accordingly, there is a need in the construction industry for a protective liner assembly which overlies the exposed surface portions of a fascia board or like fascia member, almost without regard to its configuration or dimension, and particularly but not limited to, the vicinity of end joints or seams where abutting ends of the fascia member engage one another. Any such protective liner assembly should also be readily usable in the repair of fascia members already installed on a building structure. Further, any such protective liner assembly should be formed of a water proof or water resistant material that is capable of securely engaging the exposed surface portions of the fascia member in a manner which does not compromise the fascia surfaces, so as to prevent or at least significantly reduce rotting or other deterioration. More specifically, the inner, contact face of any such protective liner assembly for fascia members should sealingly engage the exposed surfaces of the fascia members so as prevent the seepage of water therebetween. Also, the material from which the protective liner assembly is formed should be readily suited for being painted or otherwise finished to reflect a variety of trim colors, styles or finishes that are or will be utilized on a building structure. Further, the material from which any such protective liner assembly is formed would ideally have sufficient flexibility to be oriented or disposed on a roll so as to define a stored position having a reduced volume to facilitate either the storage and/or packaging thereof, and further, should be capable of being selectively oriented in an operative and protective position on or about one or more fascia members. Finally, the installation of any such protective liner assembly in the operative and protective position should be both very quick and easy, while at the same time, requiring the use of only a couple of household tools.

SUMMARY OF THE INVENTION

The present invention is designed to address these and other needs which remain in the art and is directed towards a protective liner assembly. In the preferred embodiments of the present invention, the protective liner assembly comprises an elongated strip made from a light weight, flexible plastic, vinyl or other substantially equivalent material, which has sufficient flexibility to be rolled upon itself, along its length and from end to end. When in a roll, preferably of the type having a spiral configuration, the protective liner strip is, and preferably a plurality of them are, in a stored position. When ready for use, the strip is unrolled and oriented into an operative position for overlying, at least partially sealing engagement with a plurality of exposed surface portions of a fascia board, strip or other fascia member. It is pointed out that if the roll is of sufficient length to contain a plurality of strips, that a portion of the roll is unrolled and measured to define an elongated strip of an appropriate dimension, then cut and installed in the operative position relative to the fascia board or other fascia member.

More specifically, the elongated liner strip of the present invention is intended to be positioned in an overlying, protective relation to a fascia board or other fascia member, including, but not limited to an end joint or seam defined by correspondingly positioned ends of the fascia members, disposed in abutting relation to one another. Accordingly, the plurality of exposed surface portions of the corresponding ends of the adjacent fascia boards or members are substantially encased or enclosed, so as to prevent or substantially restrict the seepage of water into the abutting ends or other surface portions of the fascia members. In addition, deterioration of the fascia members is further prevented by eliminating the use of nails, staples or other conventional penetrating connectors, normally associated with the installation and/or covering of the fascia member or other components associated with the construction of a building. As has been described previously herein, some water seepage invariably occurs at the site where a nail or other penetrating connectors penetrates the fascia member, which is typically formed of wood, and which thereby results in some deterioration, especially at corners where ends are mitered and nails are used to fasten mitered facia.

The protective liner assembly of the present invention comprises the elongated strip having oppositely disposed ends and including longitudinally extending sides or edges, preferably disposed in parallel relation to one another. The elongated strip also includes an outer, exposed face and an inner, contact face. A plurality of strip sections may also be formed on the strip, wherein adjacent ones of the strip sections are separated from one another by a plurality of weakened zones. Each of the weakened zones may be defined by an elongated score line extending along the entire length of the strip, between the opposite ends. The score lines are preferably disposed in spaced, substantially parallel relation to one another and are also disposed in parallel relation to the aforementioned longitudinal edges. By virtue of this construction, the transverse dimension of each of the plurality of strip sections will normally vary from one another but the transverse dimension of each of the strip sections will be consistent along its entire length. For example, it is generally accepted that the fascia boards or other fascia members are available in conventional sizes comprising generally a one inch thickness, which is actually ¾ of an inch as the true cut, and a transverse dimension which may vary from four inches to twelve inches. Accordingly, the plurality of strip sections may also vary accordingly in terms of their relative transverse dimension. The length of each of the strip sections, as set forth above, will be preferably equal, in that the strips may be made available in lengths of six feet or other appropriate lengths, but could also be measured and cut to an appropriate length if the material from which a plurality of strips are to made is formed within a continuous roll. When applied in overlying relation to an end joint and other exposed surface portions of a facia member, the original six foot length may be easily severed, transversely so as to create individual strip segments each having a predetermined length corresponding to the length of the fascia member to which the strip segment is connected.

As will be described in greater detail hereinafter, the fascia member will typically have a rectangular cross-sectional configuration, which is at least partially defined by a outer or main exterior surface, an inner surface and an under surface. These exposed surface portions are each protected by overlying, at least partially sealed engagement with respective ones of the various strip sections, such that the plurality of surface portions of the fascia member, particularly in the area of the end joint, will not be exposed to water seepage, leaks, or the like.

In the preferred embodiment, when the strip is ready for attachment to the fascia member, it is selectively disposed from its stored position and into its operative position. The operative position is defined by the strip sections being relatively oriented to one another to engage the aforementioned outer, inner and under exposed surface portions of the fascia member. The operative position is more specifically defined, due in part to the normal rectangular cross-sectional configuration of the fascia member, by a first and second strip section disposed in parallel relation to one another, with a third strip section being disposed transversely thereto, i.e., at substantially right angles to the first and second strip sections and in interconnecting relation thereto. More specifically, the aforementioned operative position may be assumed by pivoting, folding or otherwise moving the first and second strip sections relative to the adjacently positioned score lines, so as to orient them in the aforementioned parallel relation to one another. As set forth above, the score lines are formed in the outer, exposed face of the strip or are otherwise structured to allow the contact faces of each of the first and second strip sections to be folded or otherwise moved inwardly towards one another.

Another feature of the present invention is the interconnecting of the contact faces of each of the plurality of strip sections to the corresponding exposed surface portions of the fascia member by utilizing an adhesive or like composition which provides an at least partially sealing engagement therebetween. Such a sealing engagement best facilitates the elimination or reduction of water entering exposed end joints or seams between abutting, adjacently positioned fascia members, as well as other exposed surface portions of the fascia members. The use of penetrating nails or like connectors is thereby eliminated, as set forth above.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
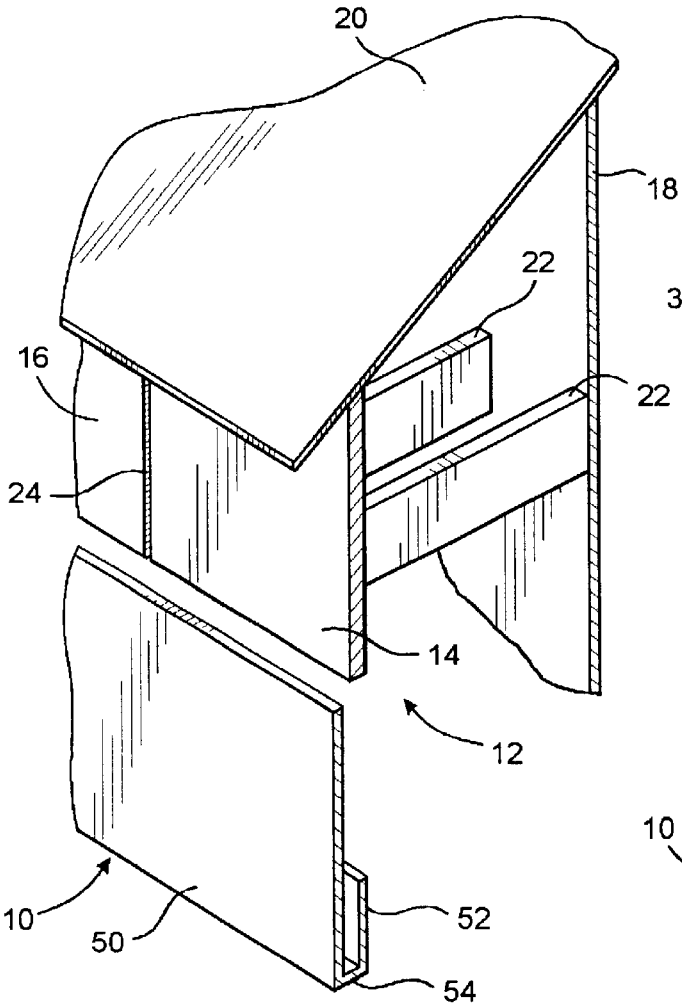
FIG. 1 is a perspective view in partial cutaway and exploded form of the fascia assembly of the present invention in an operative position immediately prior to being attached to a fascia member.
Figure 2:
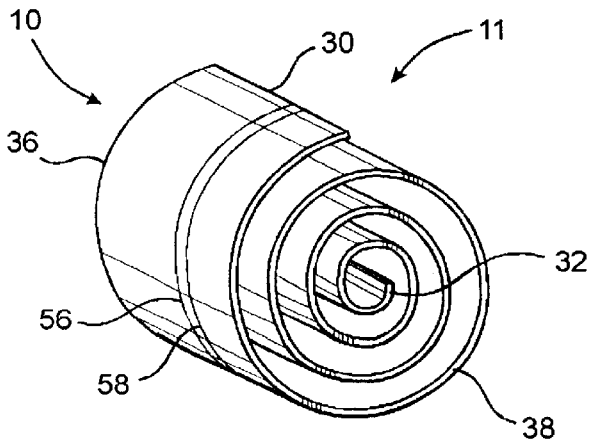
FIG. 2 is a perspective view of the protective liner assembly of the embodiment of FIG. 1, in a stored position.

As shown in the accompanying drawings, the present invention is directed to a protective liner assembly for fascia board or like fascia members installed on many buildings and homes. As is perhaps best shown in FIG. 1, the protective liner assembly of the present invention preferably comprises an elongated strip generally indicated as 10. The elongated strip 10 is preferably formed of a plastic material, a polyvinyl material or another like material which is either water proof or water resistant, and further, which is readily suited for being painted or otherwise finished to reflect and match a variety of trim colors, styles or finishes that are or will be utilized on a building structure. Ideally, the material from which the elongated strip 10 is formed will also have sufficient flexibility to be rolled upon itself into a roll 11 having a substantially spiral-like configuration and sufficient length to form a plurality of elongated strips, as generally shown in FIG. 2, so as to define a preferred stored position of the protective strip 10.

Figure 5:
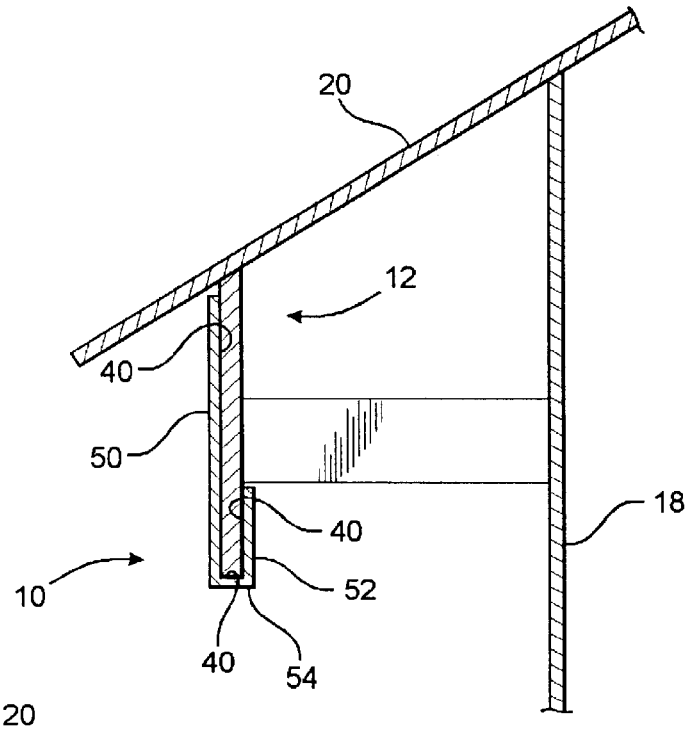
FIG. 5 is an end view of the protective liner assembly of the present invention mounted on a fascia member secured beneath a roof and attached outwardly from a vertical wall of a building.
Figure 6:
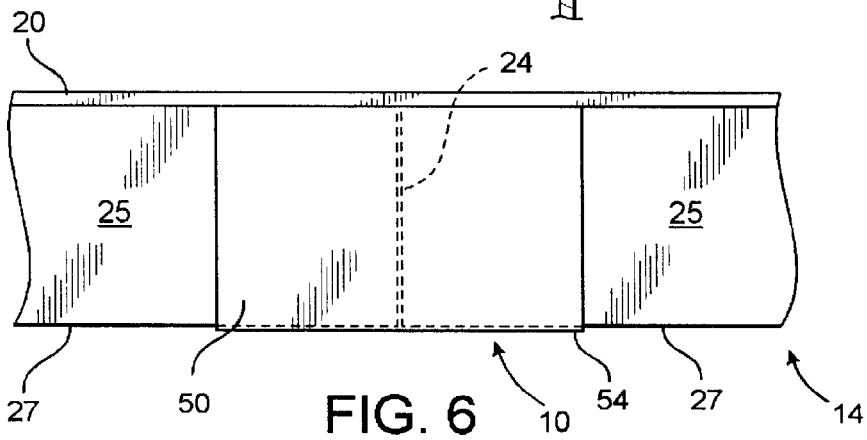
FIG. 6 is a front view in partial cutaway of the embodiment of FIG. 5.
Figure 7:
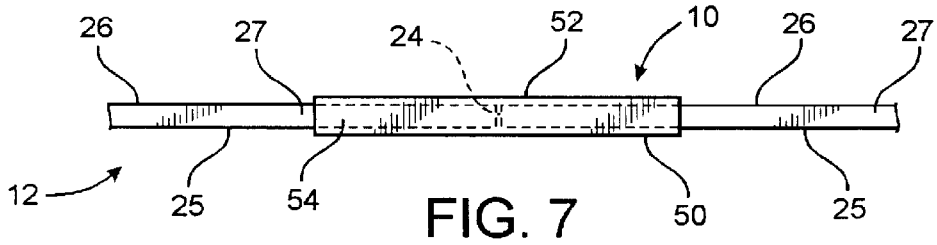
FIG. 7 is a bottom view in partial cutaway of the embodiment of FIGS. 5 and 6.
Figure 8:
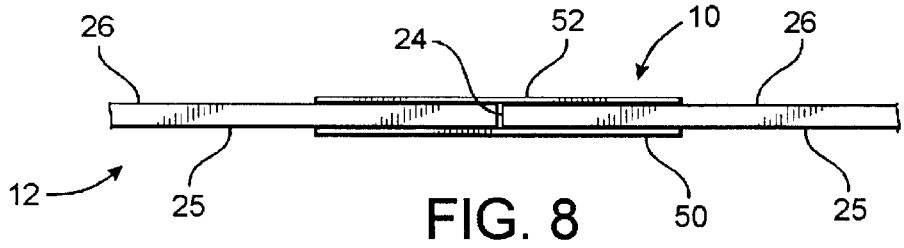
FIG 8 is a top view in partial cutaway of the embodiment of FIGS. 5 through 7.

With reference now to FIG. 1 and 5–8, the elongated strip 10 is shown in an operative position, wherein the strip 10 is connected in protective engagement to a fascia member 12. In somewhat conventional fashion, the fascia member 12 may comprise one or more fascia boards or strips 14 and 16, typically made of wood and secured exteriorly of a building wall 18 and generally beneath a roof structure 20. The fascia member or board 12 may be supported in an overlying relation to the outer ends of a plurality of support members 22, which may or may not be defined by rafters, support beams or roof trusses. As shown, the linear orientation of the fascia boards 14 and 16 results in an end joint or seam 24. The end joint or seam 24 is frequently not perfectly aligned and when not properly sealed, results in exposing the corresponding ends of each of the fascia boards 14 and 16 to moisture, such as from rain, but also to other various weather conditions. This exposure oftentimes results in the rotting of the wood at the end joint 24 or other types of deterioration. The elongated, protective liner strip 10 is therefore disposed in overlying, covering relation to the exposed surface portions of one or more fascia members 12. Such surface portions normally include an outer or main exterior surface portion 25, and inner surface or return portion 26 and an under surface portion 27, as best shown in FIGS. 6–8. The number and disposition of the plurality of surface portions is, of course, dictated by the cross-sectional configuration of the fascia member 12, which as shown in the accompanying drawings, normally comprises a rectangular cross-sectional configuration.

Figure 3:
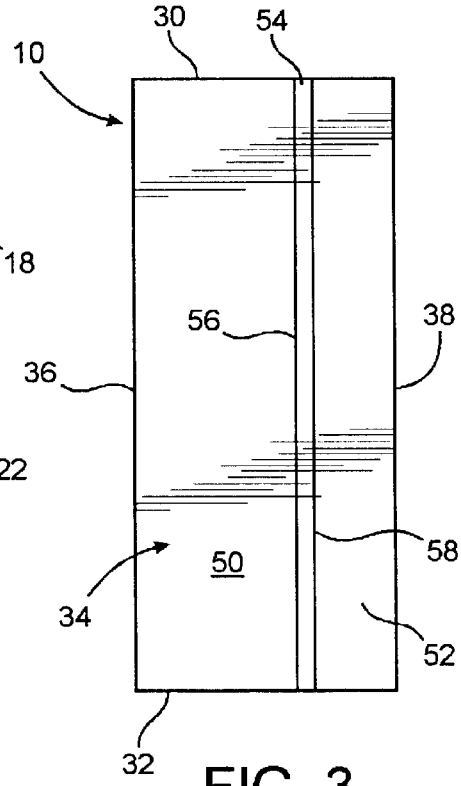
FIG. 3 is a front plan view of the protective liner assembly of the embodiments of FIGS. 1 and 2.
Figure 4:
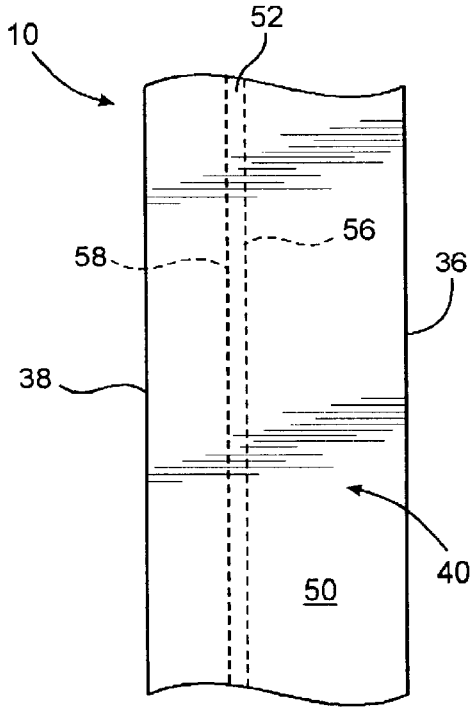
FIG. 4 is a rear view, in partial cutaway, of the embodiment of FIG. 3.

The elongated, protective liner strip 10 of the present invention further includes opposite ends 30 and 32 and an outer, exposed face 34, as shown in FIG. 3. In addition, the strip 10 comprises two oppositely disposed, spaced apart and substantially parallel longitudinal edges 36 and 38. As shown in FIG. 4, the opposite side of the elongated strip 10 comprises a contact face 40. When in its operative position and mounted on the fascia member 12, as shown in FIG. 5, the contact face 40 is disposed in overlying, substantially sealing engagement with the plurality of exposed surface portions 25, 26 and 27, as set forth above.

Referring now to FIGS. 3 and 4, in order to protectively cover all of the exposed surface portions 25, 26 and 27, of the rectangular fascia member 12, the elongated strip 10 comprises a plurality of strip sections including a first strip section 50, a second strip section 52 and a third strip section 54. Each of these strip sections are selectively foldable, pivotable or otherwise moveable from a flat, substantially co-planar relation to one another, as depicted in FIGS. 3 and 4, to the operative position as shown in FIG. 1. When in the operative position, the first section 50 and the second section 52 are disposed in substantially parallel relation to one another and the third section 54 is disposed in substantially transverse, interconnecting relation between the first and second strip sections 50 and 52, respectively. When the cross-section of the fascia member 12 is a rectangle as pictured in FIGS. 1 and 5, the third strip section 54 is oriented at substantially right angles to both the first and second strip sections 50 and 52.

In order to selectively position the plurality of strip sections 50, 52 and 54 into their operative position, as shown in FIGS. 1 and 5, the protective strip 10 preferably includes a plurality of weakened zones. More specifically, the weakened zones are preferably defined by a first and second elongated score line 56 and 58, extending along the entire length of the strip 10, between the opposite ends 30 and 32, as shown in FIGS. 3 and 4. Further, each of the first and second score lines 56 and 58 are disposed in spaced, parallel relation to one another and in parallel relation to the longitudinal edges 36 and 38. By virtue of this construction, the transverse dimension of the first, second and third strip section 50, 52 and 54, respectively, may vary relative to one another in order to accommodate the dimensions and configurations of the exposed surface portions 25, 26 and 27 of the fascia member 12. Therefore, each of the strip sections 50, 52 and 54 have a consistent transverse dimension along the respective lengths thereof, even though the respective transverse dimensions of each of the strip sections 50, 52 and 54 may vary, relative to one another.

The forming or manufacturing of the elongated strip 10 may be by extrusion, wherein the first and second score lines 56 and 58 may be integrally formed while the strip 10 is being extruded or immediately subsequent thereto defining a recessed surface or groove between the outer strip surface 25 and inner or contact surface 40. As set forth above, the material from which the strip 10 is formed has sufficient flexibility to allow it to be rolled upon itself, from end to end, to form the roll 11 and thereby define the stored position. Further, the strip 10 from which the roll 11 is formed may preferably come in predetermined lengths such as, but not limited to, six foot lengths. The material from which the elongated, protective strip 10 is formed has sufficient structural integrity to provide a protective covering for the exterior surface portions 25, 26 and 27 of the fascia member 12. At the same time, the material is sufficiently light and thin to allow an installer to cut the six foot length into a plurality of strip segments, each corresponding in length to the longitudinal dimension of the fascia member 12, which is to be covered by the individual strip segments.

Attachment of the elongated protective strip 10, once in the operative position as shown in FIG. 1, is accomplished using an adhesive or like composition, which serves to adhere, and more specifically, at least partially, sealingly engage the contact surface of the strip 10 over the plurality of exposed surface portions 25, 26 and 27. The sealing engagement prevents or significantly reduces the seepage of water between the contact surface 40 and the exposed surface portions of the fascia member 12, in order to avoid or eliminate deterioration due to wood rot, or the like.

It should be apparent that the protective strip 10 may be secured in its operative position in overlying, protective relation to the fascia member 12, without the need for most of the many ordinary tools that one would expect, other than a measuring tape and a utility knife, for measuring and cutting the elongated strip 10 into appropriately sized strip segments, and an applicator for applying the adhesive or like composition to accomplish the aforementioned sealing engagement of the contact surface 40 to the plurality of exposed surface portions of the fascia member 12. In addition, the material from which the elongated strip 10 is formed may be painted, pre-colored or tinted during its manufacture, in order to compliment any of a variety of different colors of the outer wall 18 of the building or other expose components.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A protective liner for a fascia board, the fascia board having a front main surface, a rear main surface and a lower surface, said protective liner comprising:

a) an elongate strip of bendable, cuttable, nonporous, weather and water resistant material, b) said elongate strip having opposite ends and a first and a second edge generally parallel to one another and extending between said opposite ends, a first face and a second face, and a first and a second parallel, spaced score line both generally parallel to said first and second edges;

c) said elongate strip defining a pair of spaced parallel grooves extending longitudinally between the end faces defining:

i) a first strip portion between one of said grooves and said first edge sized and configured to overlay the front main surface of the fascia board, ii) a second strip portion between the other of said groves and said second edge sized and configured to overlay a portion of the rear main surface of the fascia board along the second edge of the fascia board, iii) an intermediate strip portion between said grooves sized and configured to overlay the lower surface of the fascia board, and d) said strip material along said grooves comprising a hinge means for allowing swinging movement of said first and second strip portions from a planar attitude and into spaced parallel relation perpendicular to said intermediate portion to define a seat for receiving the lower surface of the fascia board, with said first and second strip portions confronting, respectively, the front main surface of the fascia board and at least a portion of the rear main surface of the fascia board surface generally adjacent the lower surface thereof.

2. A protective liner as set forth in claim 1 including an adhesive coating on one of said faces of said elongate strip, said face comprising a contact surface to be adhesively connected to the fascia board.

3. A protective liner as set forth in claim 1 wherein said elongate strip is made of a plastic material.

4. A protective liner as set forth in claim 2 wherein said elongate strip is made of a plastic material.

5. A protective liner as set forth in claim 1 wherein said elongate strip between said opposite ends is about six feet in length.

6. A protective liner as set forth in claim 1 wherein said elongate strip is rolled upon itself for storage and shipment in a roll form from which discrete strip lengths are adapted to be cut for use of the discrete lengths at a job site.

7. A protective liner and fascia board assembly for a building structure, the assembly to be secured in spanning relation relative to generally coplanar end faces of parallel spaced support members of the building structure comprising:

a) a fascia board having: a front surface and a back surface generally parallel to and spaced from said front surface; said front and back surfaces being in at least partial engagement with the end faces of the support members, when the fascia board is installed on a building structure, the fascia board also having spaced, opposite end surfaces and a lower surface extending longitudinally between said end surfaces;

b) a liner comprising an elongate strip of bendable, cuttable, nonporous, weather and water resistant material, said elongate strip of said liner having opposite ends and first and second edges extending generally parallel to one another between said opposite ends, a main front face and a parallel main back face;

c) said liner including spaced score lines parallel to said first and second edges in said main front face extending longitudinally between said opposite ends so as to further define:

i) a first strip portion between one of said score lines and said first edge for overlaying said outer front surface of said fascia board, ii) a second strip portion between the other of said score lines and said second edge for overlaying a portion of said back surface of the fascia board along a lower surface thereof, and iii) an intermediate strip portion between said score lines for overlaying the lower fascia board surface; and d) with said score lines of said strip comprising hinge means for permitting swinging movement of said first and second strip portions into spaced parallel relation relative to one another and yet perpendicularly oriented relative to said intermediate portion, thereby defining a seat for receiving said lower surface of said fascia board with said first strip and second strip portions confronting said fascia board front surface and a portion of said back surface, respectively.

8. An assembly as set forth in claim 7 including an adhesive coating on said inner strip face comprising a contact surface adhesively connecting to the fascia board portions.

9. An assembly as set forth in claim 7 wherein said strip material is plastic.

10. An assembly as set forth in claim 8 wherein the strip material is plastic.

* * * * *